US008348081B2

(12) United States Patent
Baptiste

(10) Patent No.: US 8,348,081 B2
(45) **Date of Patent: *Jan. 8, 2013**

(54) RETRACTABLE LOCKING COVER AND TRASH CONTAINER WITH RETRACTABLE LOCKING COVER

(76) Inventor: George H Baptiste, Baldwin, NY (US)

( * ) Notice: Subject to any disclaimer, the term of this patent is extended or adjusted under 35 U.S.C. 154(b) by 606 days.

This patent is subject to a terminal disclaimer.

(21) Appl. No.: 12/475,292

(22) Filed: May 29, 2009

(65) Prior Publication Data

US 2009/0289067 A1 Nov. 26, 2009

Related U.S. Application Data

(63) Continuation-in-part of application No. 11/580,999, filed on Oct. 16, 2006.

(51) Int. Cl.
*B65D 43/12* (2006.01)
*B65D 43/20* (2006.01)

(52) U.S. Cl. ..... 220/345.1; 220/350; 220/908

(58) Field of Classification Search ..... 220/908, 220/262, 345.1–345.3, 350, 351, 252, 822, 220/826, 315, 326, 324; 135/115; 292/137, 292/163, 171, 175, 32, 33, 37, 38, 41, 42, 292/DIG. 11; 160/32, 113, 87, 223, 370.1; 206/816

See application file for complete search history.

(56) References Cited

U.S. PATENT DOCUMENTS

| | | | | |
|---|---|---|---|---|
| 705,045 | A * | 7/1902 | Davidson | 312/297 |
| 1,892,743 | A * | 1/1933 | Wenger | 220/318 |
| 2,080,786 | A * | 5/1937 | Robles | 220/252 |
| 2,107,997 | A * | 2/1938 | Horsley | 312/297 |
| 2,153,916 | A * | 4/1939 | Dunbar | 292/38 |
| 2,739,730 | A * | 3/1956 | Jonas | 220/350 |
| 3,442,435 | A * | 5/1969 | Huston et al. | 220/528 |
| 3,509,855 | A * | 5/1970 | Priddy, Jr. | 119/497 |
| 5,761,750 | A * | 6/1998 | Mazzola et al. | 4/500 |
| 5,816,591 | A * | 10/1998 | Parker et al. | 280/47.34 |
| 7,073,677 | B2 * | 7/2006 | Richardson et al. | 220/4.32 |
| 2006/0101943 | A1 * | 5/2006 | Snow et al. | 75/252 |

FOREIGN PATENT DOCUMENTS

GB 2414376 A * 11/2005

* cited by examiner

*Primary Examiner* — Robin Hylton
(74) *Attorney, Agent, or Firm* — Maier & Maier PLLC

(57) ABSTRACT

A retractable cover is provided. The retractable cover may include a leading cover member; and a plurality of following cover members, each of the plurality of following cover members may be hingedly coupled to at least one of the leading cover member and one adjacent following cover member.

13 Claims, 15 Drawing Sheets

RETRACTABLE LOCKING COVER AND TRASH CONTAINER WITH RETRACTABLE LOCKING COVER

CROSS-REFERENCE TO RELATED APPLICATIONS

This application is a continuation-in-part of U.S. application Ser. No. 11/580,999, filed Oct. 16, 2006, and entitled TRASH CONTAINER WITH RETRACTABLE WEATHERPROOF COVER, the disclosure of which is incorporated by reference herein in its entirety.

BACKGROUND OF THE INVENTION

Present containers have basic means for covering articles contained therein. Such coverings offer little protection from natural elements and may lead to loss of contents from wind, mishandling, animals or other factors. Some present containers have coverings that are separable from the container and are therefore susceptible to separation and loss or theft. Other containers have coverings that are attached, but provide minimal protection from the elements.

Current containers comprise a cover having a roll-top design, a concentrically arranged sliding design, and a hinge design. Such designs offer a small degree of protection from weather and offer a degree of strength that can withstand only minor stress. As such the contents of present containers are prone to weather related damage as well as inadvertent spills and theft.

BRIEF DESCRIPTION OF THE INVENTION

In one exemplary embodiment, a retractable cover is provided. The retractable cover may include a leading cover member; and a plurality of following cover members, each of the plurality of following cover members may be hingedly coupled to at least one of the leading cover member and one adjacent following cover member.

In another exemplary embodiment, a container system is provided. The container system may include a bin portion that may include a bottom portion and a plurality of sidewalls extending away from the bottom portion such that an internal cavity may be defined within the bin portion; a top portion that may include a horizontal portion coupled to a vertical portion, the top portion may be removably coupled to the bin portion such that at least a portion of the vertical portion may be coupled within the bin portion; and a retractable cover slidably coupled to the top portion, the retractable cover may include a plurality of cover members.

BRIEF DESCRIPTION OF THE DRAWINGS

Advantages of embodiments of the present invention will be apparent from the following detailed description of the exemplary embodiments. The following detailed description should be considered in conjunction with the accompanying figures in which.

DETAILED DESCRIPTION OF THE INVENTION

Figure 1:
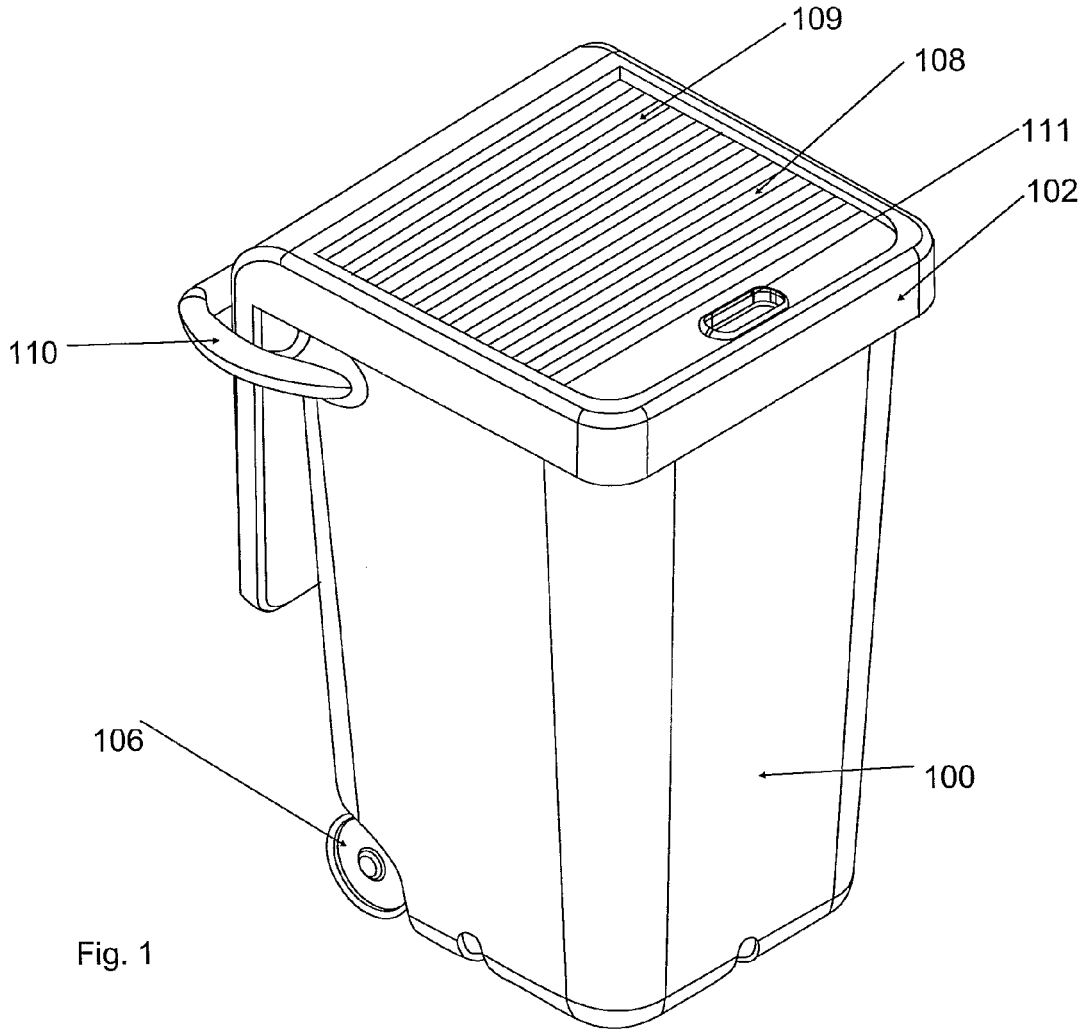
FIG. 1 shows an exemplary perspective view of a container having a retractable cover in the closed position.
Figure 6:
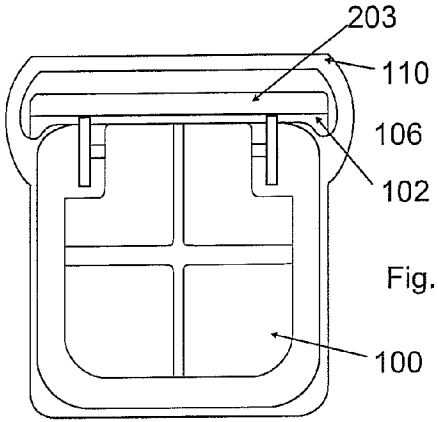
FIG. 6 shows and exemplary bottom view of the container of FIG. 1.
Figure 7:
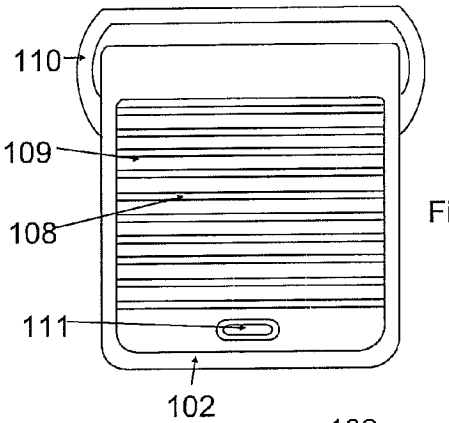
FIG. 7 shows an exemplary top view of the container of FIG. 1 with a cover in the closed position.
Figure 5:
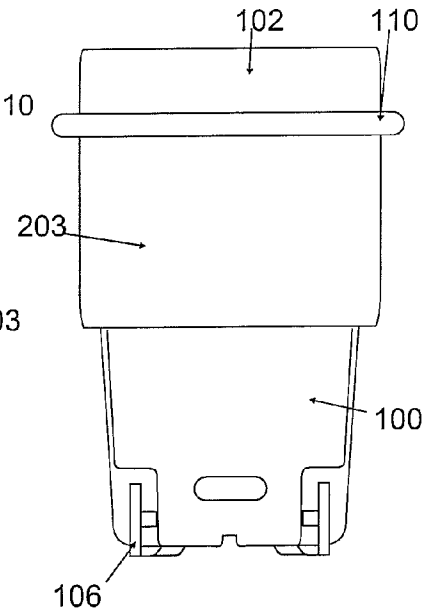
FIG. 5 shows an exemplary rear view of the container of FIG. 1.
Figure 4:
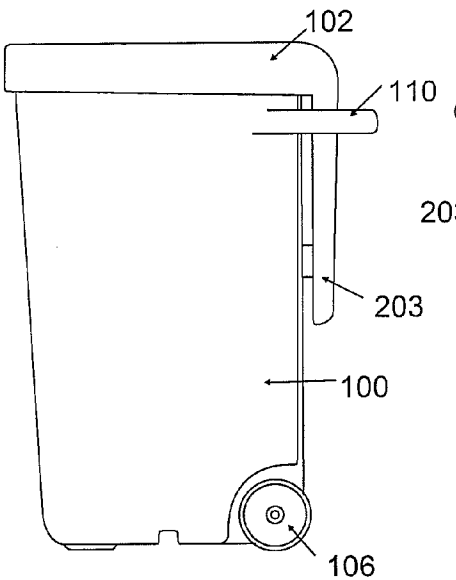
FIG. 4 shows an exemplary opposite side view of the container of FIG. 1.
Figure 3:
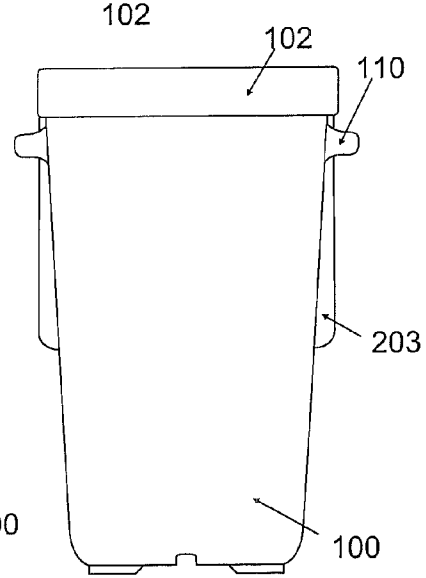
FIG. 3 shows an exemplary front view of the container of FIG. 1.
Figure 2:
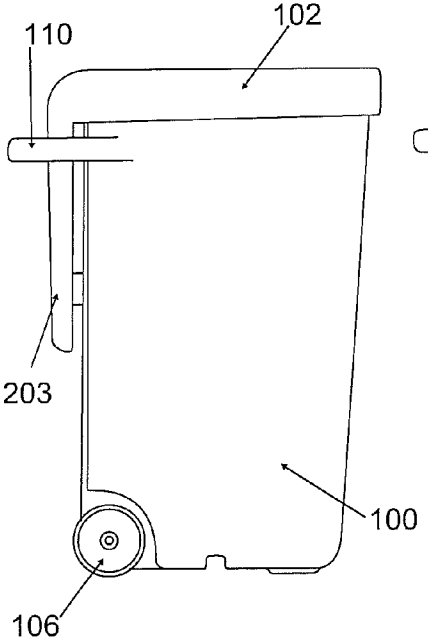
FIG. 2 shows an exemplary side view of the container of FIG. 1.

Aspects of the present invention are disclosed in the following description and related figures directed to specific embodiments of the invention. Those skilled in the art will recognize that alternate embodiments may be devised without departing from the spirit or the scope of the claims. Additionally, well-known elements of exemplary embodiments of the invention will not be described in detail or will be omitted so as not to obscure the relevant details of the invention.

As used herein, the word "exemplary" means "serving as an example, instance or illustration." The embodiments described herein are not limiting, but rather are exemplary only. It should be understood that the described embodiment are not necessarily to be construed as preferred or advantageous over other embodiments. Moreover, the terms "embodiments of the invention", "embodiments" or "invention" do not require that all embodiments of the invention include the discussed feature, advantage or mode of operation.

Referring generally to FIGS. 1-14, a trash container with a retractable cover is shown. An exemplary embodiment may include a container 100, a top portion 102, a wheelset 106 for transport, a cover 108, cover members 109, a handle 110 for moving the container, and a handle 111 for opening and closing cover 108. In one exemplary embodiment, the lower portion of container 100 may be about 6 to 26 inches wide, but more preferably 16 inches wide. Top portion 102 may be about 10 to 30 inches wide, but preferably 19 inches wide. The top portion of container 100 may be about 10 to 30 inches wide, but preferably 19 inches wide. Container 100 and attached top portion 102 may be about 20 to 40 inches tall, but preferably 35 inches tall.

FIG. 1 shows an exemplary embodiment of a trash container with retractable cover. One exemplary embodiment may include container 100 with wheelset 106 situated on the bottom portion of container 100 to allow transport. A handle 107 may be positioned on the lower portion of container 100 to accommodate lifting. Top portion 102 may be formed to accommodate slidably mounted cover 108 comprised of cover members 109. Handle 110 may be formed on the rear of container 100 to allow for transportation of the trash container. Handle 111 may be formed on cover 108 to accommodate positioning of cover 108.

FIGS. 2-7 show an exemplary embodiment of a trash container. The trash container may include container 100 having wheelset 106 arranged to provide a transport means. The bottom of container 100 may include a support structure 112 formed distally to wheelset 106 to increase stability of container 100. Top portion 102 may include cover 108, which may comprise cover members 109. Handle 111 may be used to reposition cover 108 to allow for insertion, removal, or covering of the contents of container 100. Handle 110 may be used to reposition the container.

Figure 8:
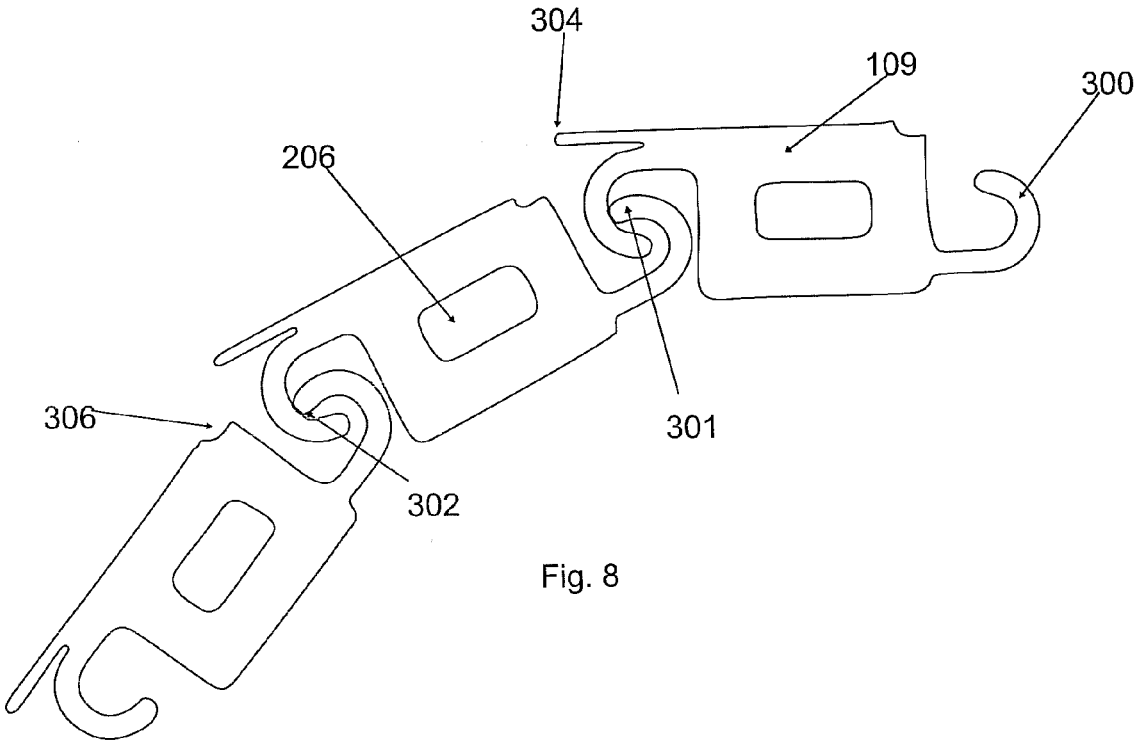
FIG. 8 shows an exemplary diagrammatical side view of a retractable cover.

FIG. 8 shows an exemplary embodiment of cover 108 and cover members 109. Cover members 109 may include flanges 206. One embodiment of cover members 109 may include a hook-shaped member 300 formed on opposing and parallel sides of individual member 109. Hook-shaped member 300 may be formed to include a distal portion 301 arranged to contact a concave portion of hook-shaped member 300 of an adjacent cover member 109 so as to form a linkage 302 thereby accommodating interlinking of consecutive members 109. Yet another embodiment of cover member 109 may include an overhang 304. Cover members 109 may be formed to include an overhang groove 306 capable of accepting and appropriately positioned to accept overhang 304. Cover 108 may be arranged so that when in the closed position, overhang 304 is accepted by overhang groove 306, and cover 108 creates a substantially sealed container thereby protecting contents of the container from weather and outside elements.

Figure 9:
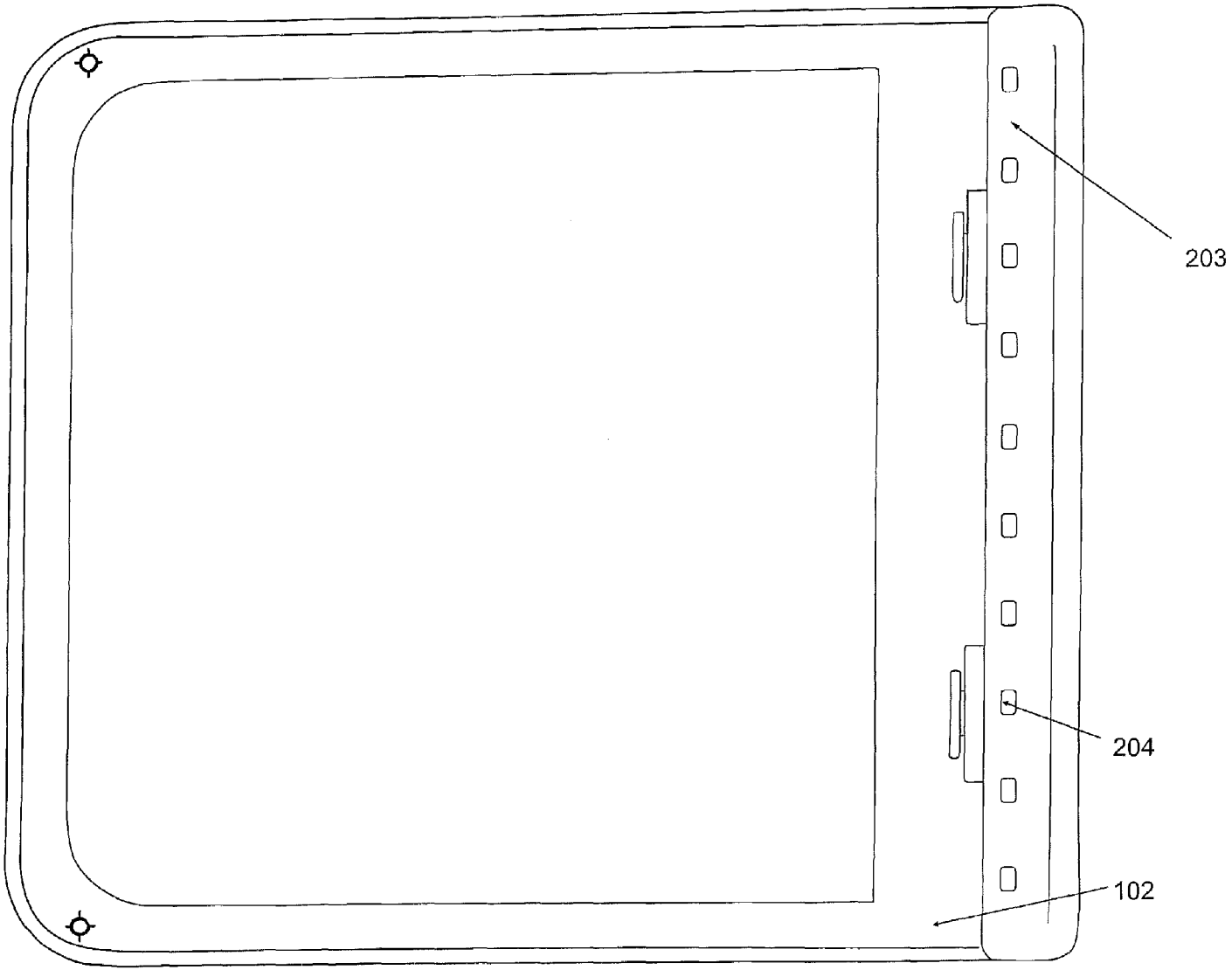
FIG. 9 shows an exemplary bottom view top portion of the container of FIG. 1.

FIG. 9 shows a bottom view of an exemplary embodiment of top portion 102. A vertical portion 203 of top portion 102 may be formed to include drainage holes 204. In one exemplary embodiment, drainage holes 204 may be formed in both vertical portion 203 and the horizontal portion of top portion 102.

Figure 12:
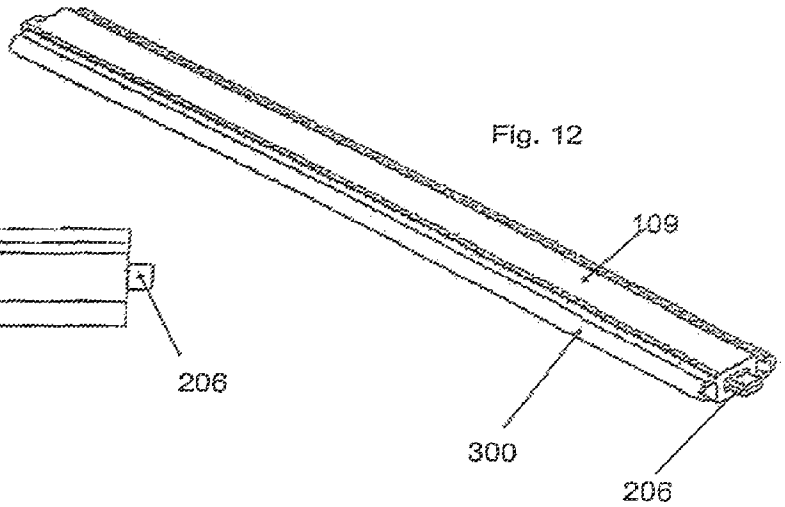
FIG. 12 shows an exemplary perspective view of a cover member.
Figure 10:
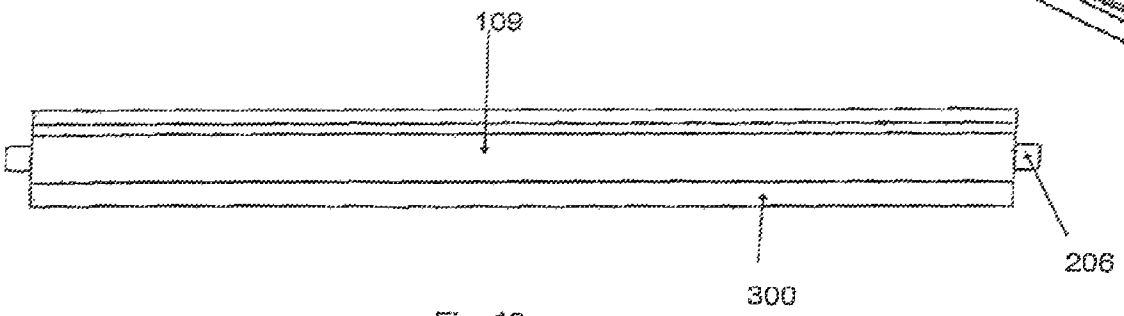
FIG. 10 shows an exemplary top view of a cover member.
Figure 11A:
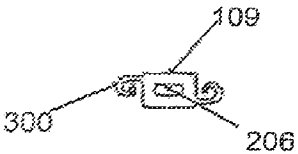
FIG. 11*a* shows an exemplary front view of a cover member.
Figure 11B:
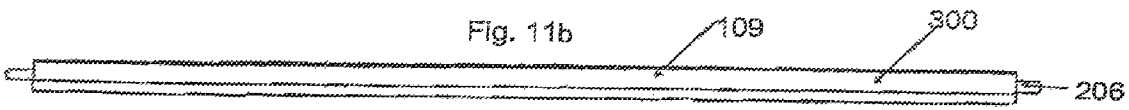
FIG. 11*b* shows an exemplary side view of a cover member.

FIGS. 10-12 show an exemplary embodiment of cover member 109. Cover member 109 may include a first hook member 300 positioned on a first end of member 109 parallel to an inverted second hook member 300 formed on an opposing second end of member 109. This allows interlocking with hook member 300 of an adjacent cover member 109. Cover member 109 may also include a flange 206.

Figure 13:
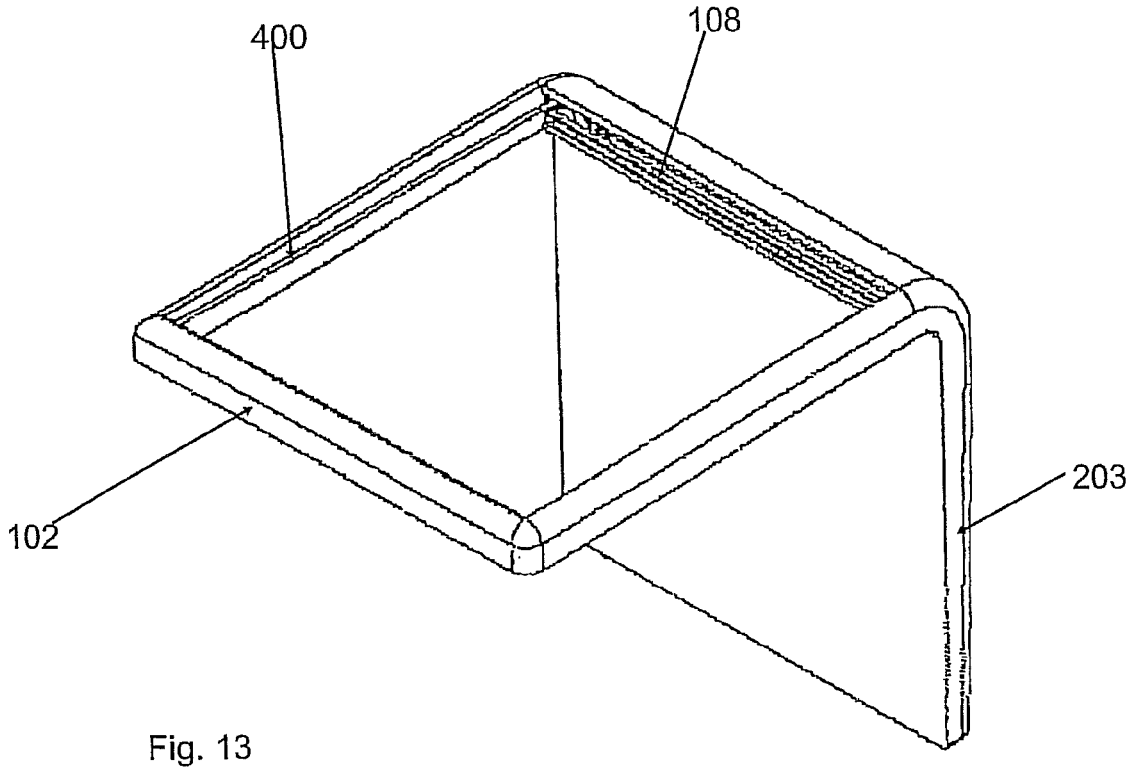
FIG. 13 shows an exemplary perspective view of the top portion of the container of FIG. 1.

FIG. 13 shows an exemplary embodiment of top portion 102. Top portion 102 may include inwardly facing grooves 400 wherein cover 108 may be slidably mounted. Grooves 400 may be formed to accommodate flanges 206. One embodiment of top portion 102 may include vertical portion 203 formed from top portion 102 wherein cover 108 may be position when retracted. A further exemplary embodiment may include flanges attached to grooves 400 that act upon cover 108 when closed so as to require applied pressure to reposition cover 108 to a substantially open position.

Figure 14:
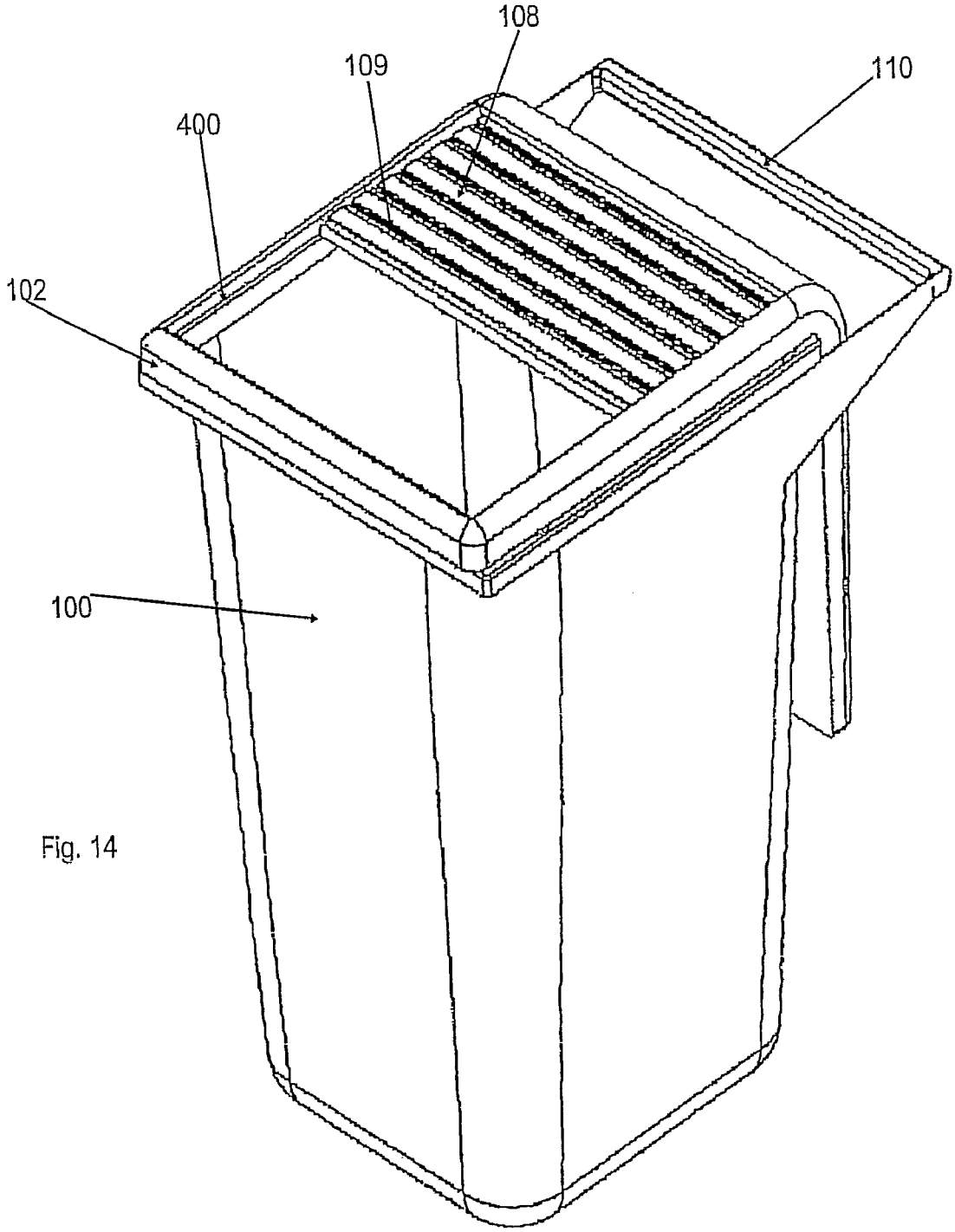
FIG. 14 shows an exemplary perspective view of a container with retractable cover in a substantially open position.

FIG. 14 shows one exemplary embodiment of a trash container with retractable cover, which may include container 100 having top portion 102, which forms an opening for container 100. Container 100 may include a handle joined to the rear of container 100 for transport or relocation. Top portion 102 may include inwardly facing parallel grooves 400 wherein cover 108 may be slidably mounted. Flanges mounted within grooves 400 may be constructed to act upon cover 108 thereby fastening cover 108 in the closed position.

Figure 15:
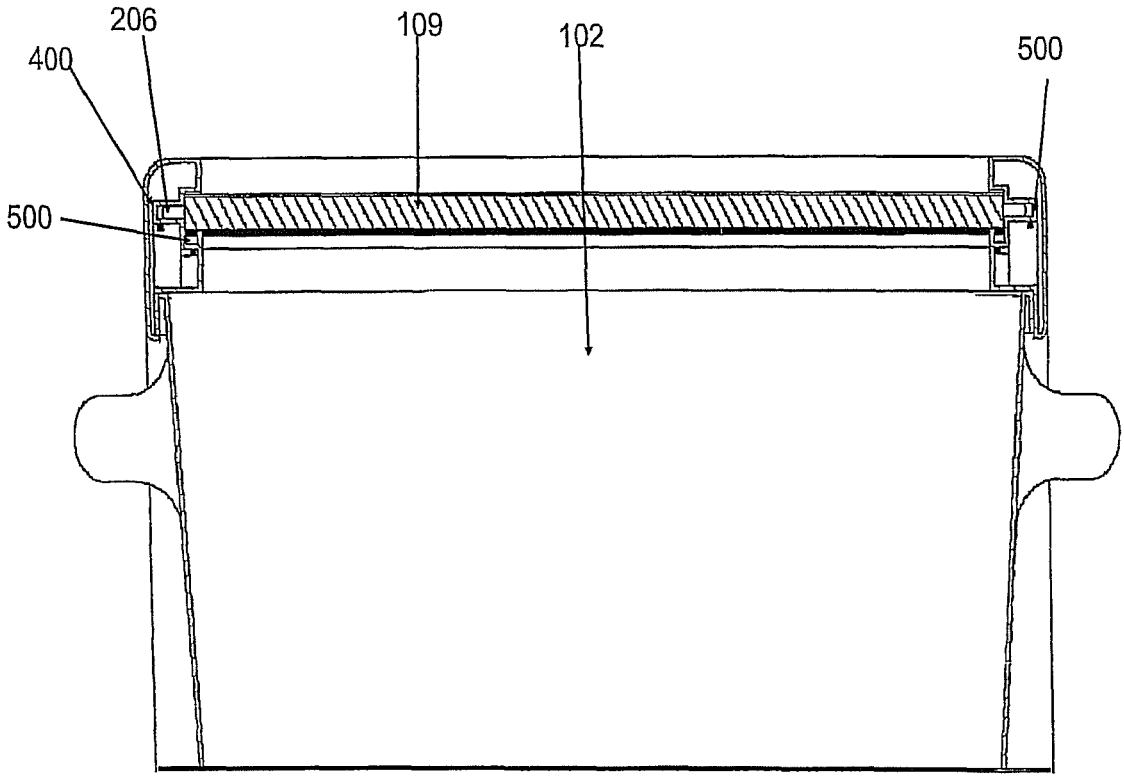
FIG. 15 shows an exemplary cross-sectional view of the top portion of the container of FIG. 1.

FIG. 15 shows an exemplary embodiment of top portion 102. Flanges 206 of cover members 109 may be positioned in grooves 400 so as to allow water to flow into a drainage canal 500. In one exemplary embodiment, drainage canal 500 may be constructed to guide water to efflux from drainage holes 204.

Figure 17:
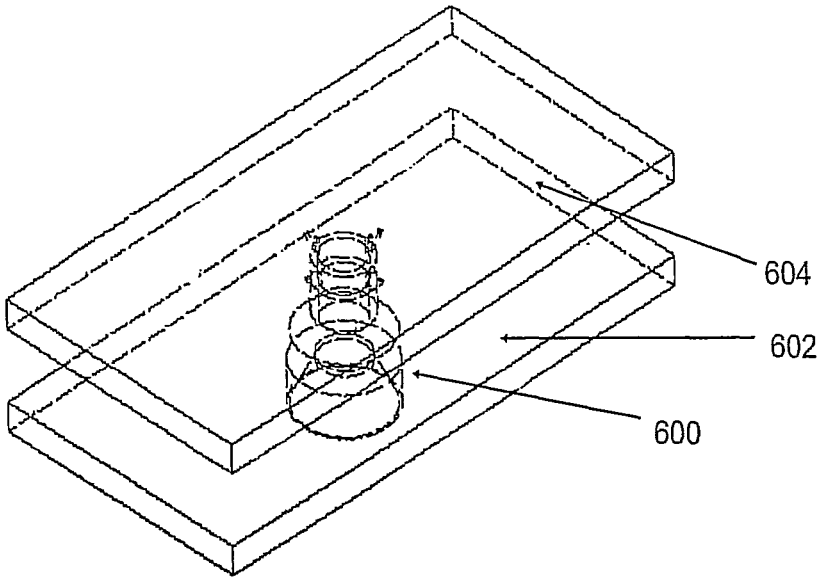
FIG. 17 shows an exemplary perspective view of the attachment mechanism of FIG. 16.
Figure 16:
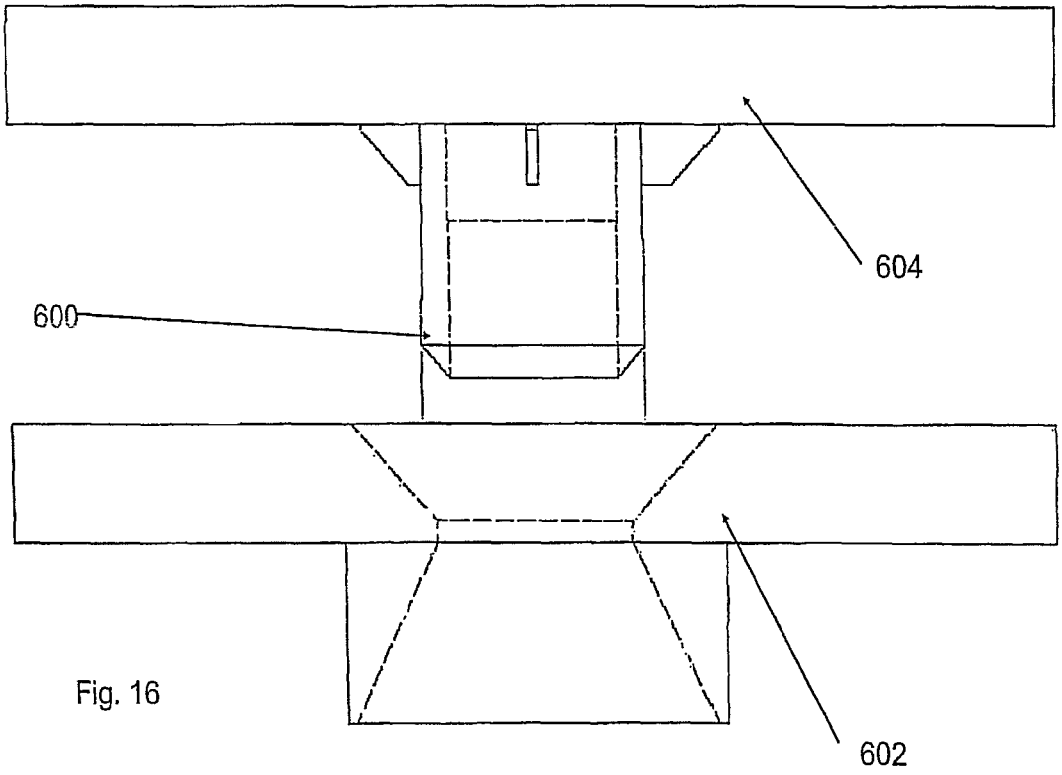
FIG. 16 shows an exemplary diagrammatical view of an attachment mechanism.
Figure 18:
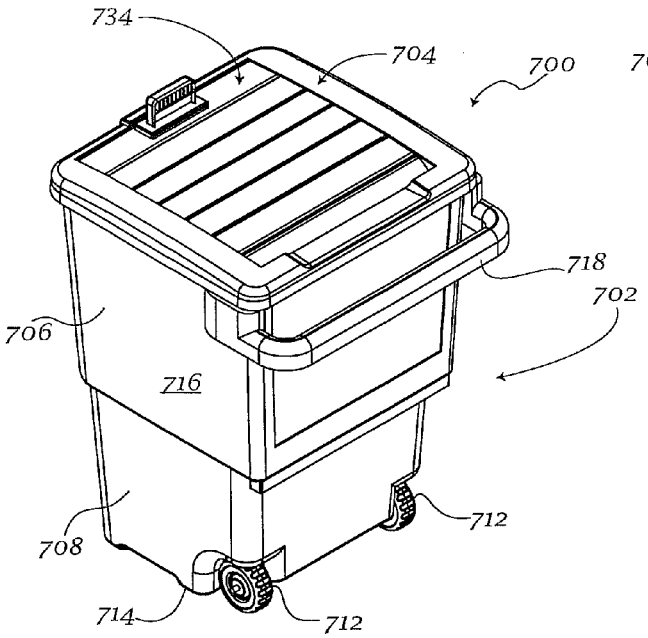
FIG. 18 is a perspective view of an alternative container.

FIGS. 16-17 show an exemplary embodiment of a fastener assembly 600. One or more fasteners 600 may be situated to interface with top portion 102 and container 100 thereby fastening top portion 102 to container 100. In one exemplary embodiment, a female fastener 602 attached to container 100 may be arranged to accommodate receipt of a male fastener 604 attached to top portion 102 thereby fastening top portion 102 to container 100. This arrangement can accommodate shipment of the container in separate components for subsequent assembly.

Figure 23:
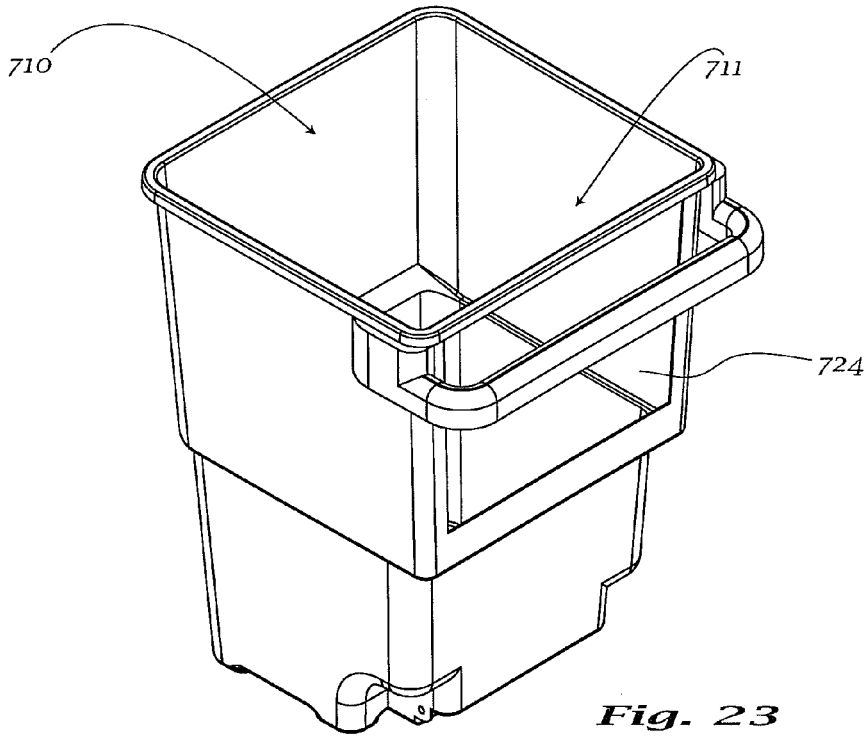
FIG. 23 is a perspective view of the container shown in FIG. 18.

Turning to an alternative embodiment, FIGS. 18-36 show various views of an alternative trash container 700. In one embodiment, trash container 700 may include a bin portion 702 and a top portion 704 coupled thereto. Bin portion 702 may include an upper bin portion 706, a lower bin portion 708 and a top opening 710 defined in upper bin portion 706, as best shown in FIG. 23. Bin portion 702 may also define an internal cavity 711 wherein garbage and other refuse may be deposited, as best shown in FIG. 23. In one embodiment, upper bin portion 706 may define an upper portion of internal cavity 711 that has a greater volume than a lower portion of internal cavity 711 defined by lower bin portion 708. Trash container 700 may also include a wheelset 712 coupled to lower bin portion 708, wherein wheelset 712 facilitates transporting trash container 700 short distances. Moreover, lower bin portion 708 may include a base 713 that may have a plurality of legs 714 extending away therefrom, which may facilitate stabilizing trash container 700 in a substantially upright position. In the exemplary embodiment, trash container 700 has four legs 714 extending away from base 713. Alternatively, trash container 700 may have any number of legs 714 that enable trash container 700 to function as described herein.

Figure 24:
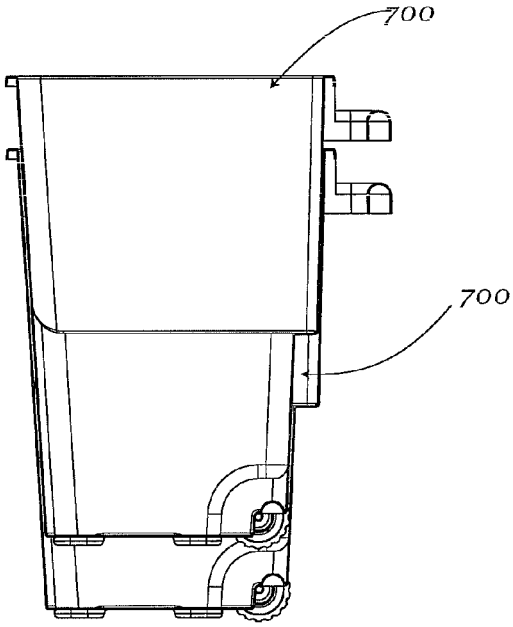
FIG. 24 is a cross-section side view of the container shown in FIG. 18 with another container stacked therein.
Figure 25:
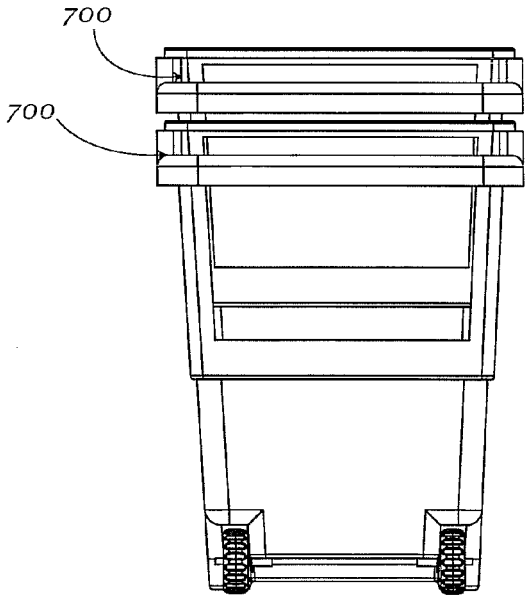
FIG. 25 is a back view of the container shown in FIG. 18 with another container stacked therein.

In one embodiment, bin portion 702 may include sidewalls 716 that are substantially tapered from top opening 710 to base 713 of lower bin portion 708. In such an embodiment, a width and a length dimension of base 713 may be substantially smaller than a respective width and length dimensions of top opening 710. Tapered sidewalls 716 enable multiple bin portions 702 to be stacked within one another. The stacking feature facilitates efficient storage and transport of multiple trash containers 700, as shown in FIGS. 24 and 25. As a result, the amount of space required to store a plurality of trash containers 700 may be reduced due to the stacking feature of trash containers 700.

Figure 20:
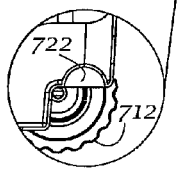
FIG. 20 is an enlarged cross-sectional side view of the container shown in FIG. 19.
Figure 21:
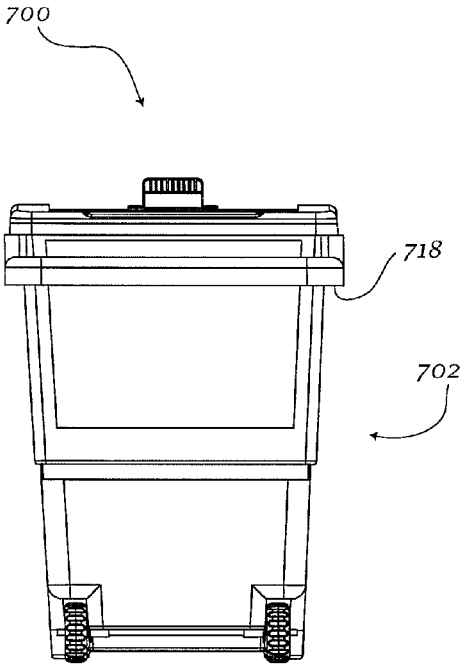
FIG. 21 is a back view of the container shown in FIG. 18.
Figure 22:
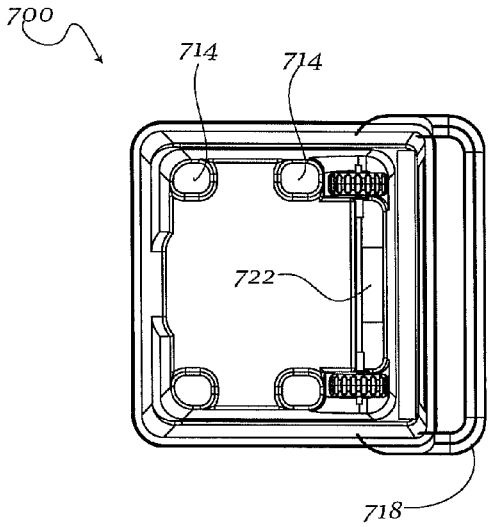
FIG. 22 is a top view of the container shown in FIG. 18.

Trash container 700 may also include a handle 718 extending away from a top of bin portion 702. In one embodiment, trash container 700 may include a handle assist indentation 722 defined in lower bin portion 708, as shown in FIG. 20. In the exemplary embodiment, handle assist indentation 722 may be positioned substantially between wheelset 712 to facilitate gripping trash container 700 by a user during lifting of trash container 700.

In one embodiment, trash container 700 may have one sidewall 716 that has an aperture window 724 defined therein, as shown in FIG. 23. As described in more detail below, top portion 704 may be coupled to bin portion 702 such that at least a part of top portion 704 may be positioned within aperture window 724 to facilitate preventing access to internal cavity 711 from persons or animals positioned outside of trash container 700. Moreover, in such an embodiment, aperture window 724 facilitates minimizing the weight of trash container 700 by removing unneeded amounts of material.

Figure 26A:
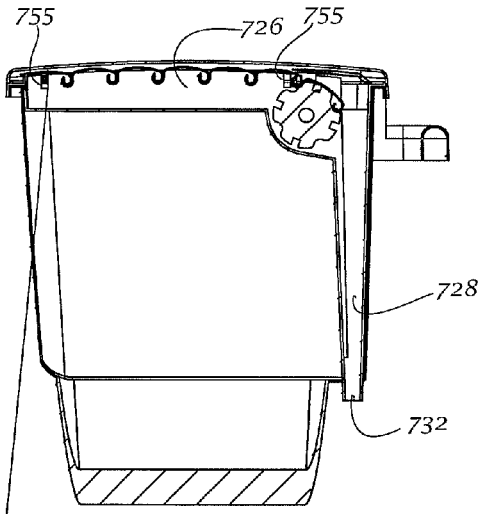
FIG. 26*a* is an enlarged cross-sectional side view of the container shown in FIG. 18 with a top portion coupled thereto.
Figure 27A:
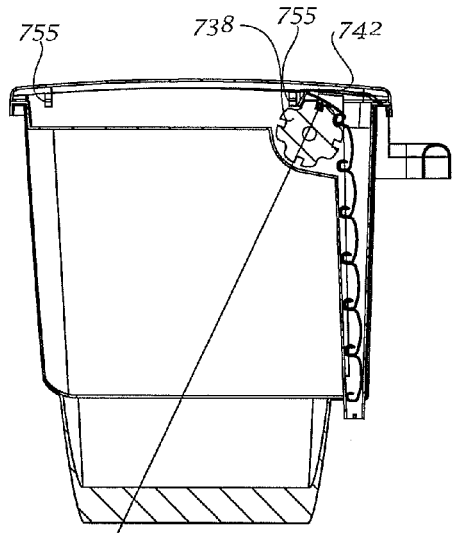
FIG. 27*a* is an enlarged cross-sectional side view of the container shown in FIG. 18 with a top portion coupled thereto.
Figure 26B:
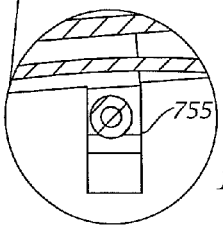
FIG. 26*b* is an enlarged cross-sectional view of the top portion shown in FIG. 26*a*.
Figure 27B:
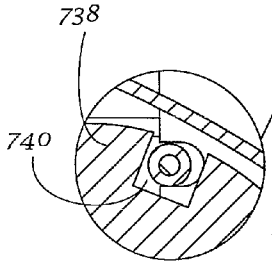
FIG. 27*b* is an enlarged cross-sectional view of the top portion shown in FIG. 27*a*.
Figure 28:
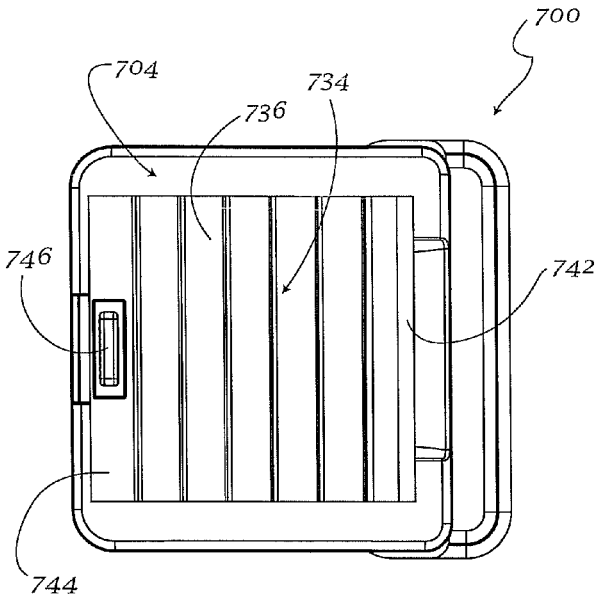
FIG. 28 is a top view of the container shown in FIG. 18 with a top portion coupled thereto having a retractable cover that is substantially closed.
Figure 29:
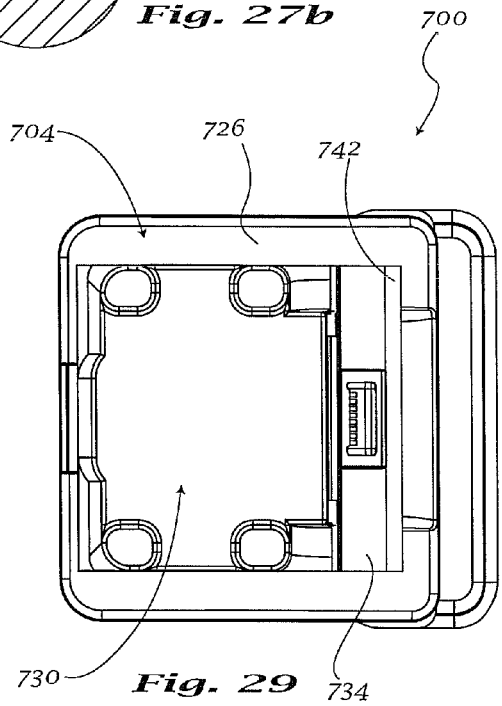
FIG. 29 is a top view of the container shown in FIG. 18 with a top portion coupled thereto having a retractable cover that is substantially open.
Figure 30:
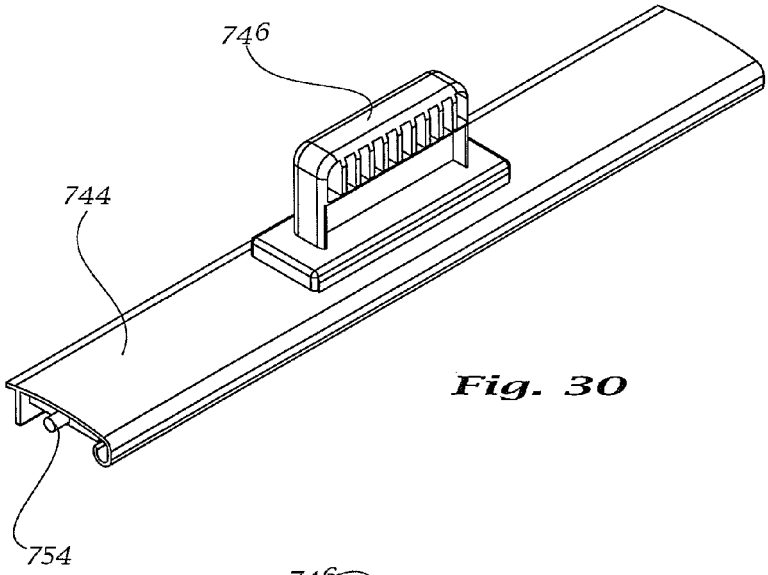
FIG. 30 is a perspective view of a leading cover member that may be used with the container shown in FIG. 18.
Figure 31:
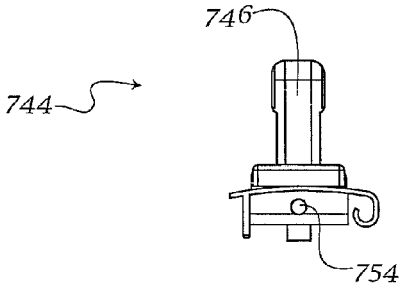
FIG. 31 is a side view of the leading cover member shown in FIG. 30.
Figure 32:
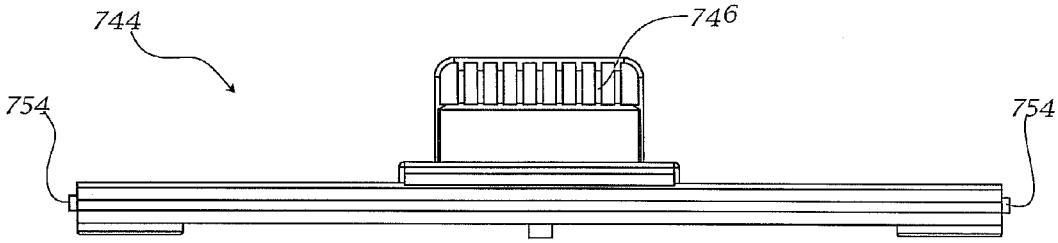
FIG. 32 is a front view of the leading cover member shown in FIG. 30.
Figure 33:
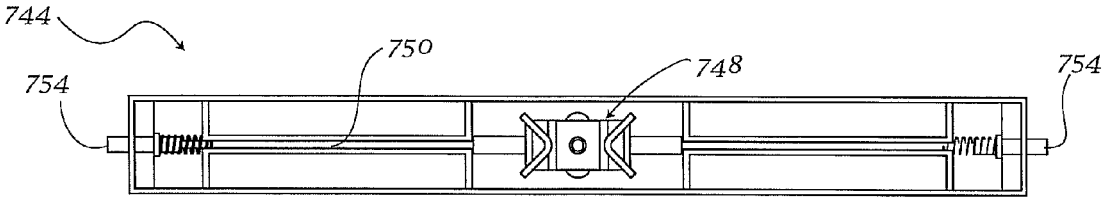
FIG. 33 is a bottom view of the leading cover member shown in FIG. 30.

FIG. 26*a* is a cross-sectional side view of trash container 700 and FIG. 26*b* is an enlarged cross-sectional side view of top portion 704, as described in more detail below. FIG. 27*a* is a cross-sectional side view of trash container 700 and FIG. 27*b* is an enlarged cross-sectional side view of top portion 704, as described in more detail below. FIGS. 28 and 29 show various views of top portion 704 coupled to bin portion 702. As described above, top portion 704 may be coupled to bin portion 702 to form trash container 700. In one embodiment, top portion 704 may include a first, or horizontal portion 726 and a second, or vertical portion 728 coupled thereto, wherein horizontal portion 726 is oriented at a substantially right-angle with respect to vertical portion 728. Top portion 704 may also include a container opening 730 defined in horizontal portion 726, as best shown in FIG. 29. Moreover, top portion 704 may include a plurality of drainage apertures 732 defined in horizontal portion 726 to facilitate draining water from within horizontal portion 726.

Figure 19:
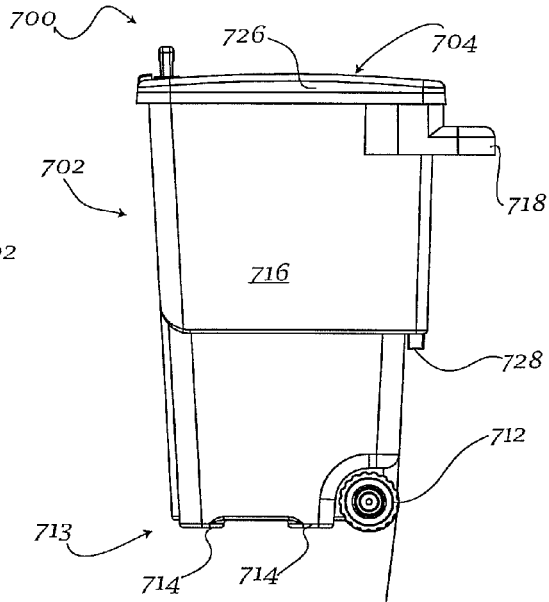
FIG. 19 is a side view of the container shown in FIG. 18.

Top portion 704 may be coupled to upper bin portion 706 such that internal cavity 711 is substantially sealed. In one embodiment, horizontal portion 726 may be coupled to bin portion 702 using a snap-fit arrangement. In another embodiment, horizontal portion 726 may be coupled to bin portion 702 using clasps, fasteners and/or any other coupling means known to a person having ordinary skill in the art that enables trash container 700 to function as described herein. Moreover, at least a portion of vertical portion 728 may be positioned substantially within aperture window 724 such that vertical portion 728 may substantially seal aperture window 724. In one embodiment, a portion of vertical portion 728 may extend away from upper bin portion 706, as best shown in FIGS. 19 and 26*a*. As a result, top portion 704 is coupled to bin portion 702 such that a portion of top portion 704 is positioned within bin portion 702, which may facilitate preventing decoupling of top portion 704 from bin portion 702 in the event trash container 700 is knocked over.

In one embodiment, top portion 704 may also include a retractable cover 734 that may be slidably coupled to top portion 704 and positioned within opening 730. Retractable cover 734 may slide within top portion 704 from a substantially closed position to a substantially open position, as described in more detail below. Retractable cover 734 may include a plurality of cover members 736 that are hingedly coupled to other adjacent cover members 736. In one embodiment, each cover member 736 may have a width that is sized to facilitate transitioning retractable cover 734 from a substantially vertical orientation, or open position, to a substantially horizontal orientation, or closed position. As a result, adjacent cover members 736 may hingedly rotate with respect to one another such that a first cover member may rotate in a range between about 0° to about 90° with respect to an adjacent second cover member 736 that is hingedly coupled to the first cover member 736. Each cover member 736 may also have a length that is sized to fit within opening 730 such that retractable cover 734 may slide within top portion 704.

Top portion 704 may also include a pair of tracking wheels 738 that facilitates transitioning retractable cover 734 between a substantially open position and a substantially closed position. Tracking wheels 738 may be rotatably coupled to the sides of top portion 704 and positioned within top portion 704 such that tracking wheels 738 may contact retractable cover 734. In one embodiment, tracking wheels 738 may include a plurality of grooves 740 that are sized and oriented along a circumference of tracking wheel 738 to facilitate engaging retractable cover 734, as shown in FIG. 27*b*. Moreover, tracking wheels 738 facilitate positioning retractable cover 734 substantially adjacent guard member 742 such that a portion of guard member 742 contacts an outside surface of retractable cover 734 to facilitate preventing debris, such as leaves, twigs and the like, from entering trash container 700 and more specifically, top portion 704. In one embodiment, guard member 742 may be coupled to an end of top portion 704 and positioned adjacent retractable cover 734.

Figure 34:
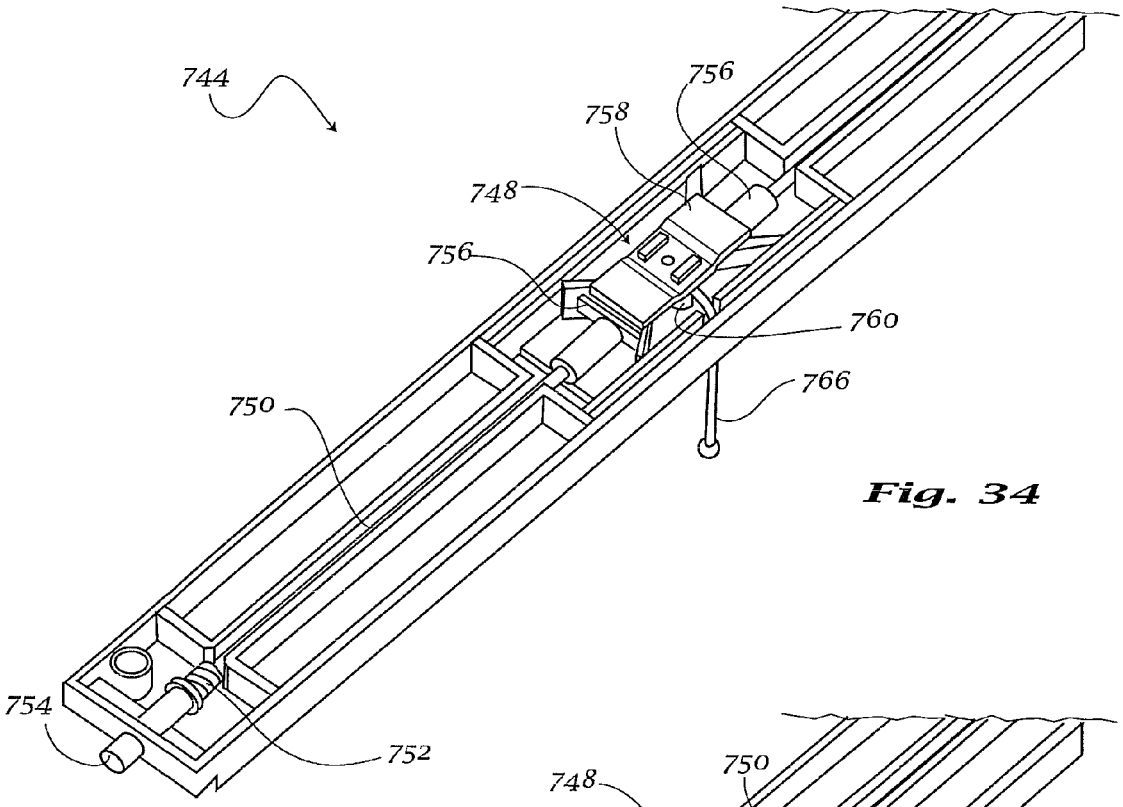
FIG. 34 is a perspective bottom view of the leading cover member shown in FIG. 30 that includes a locking assembly.
Figure 35:
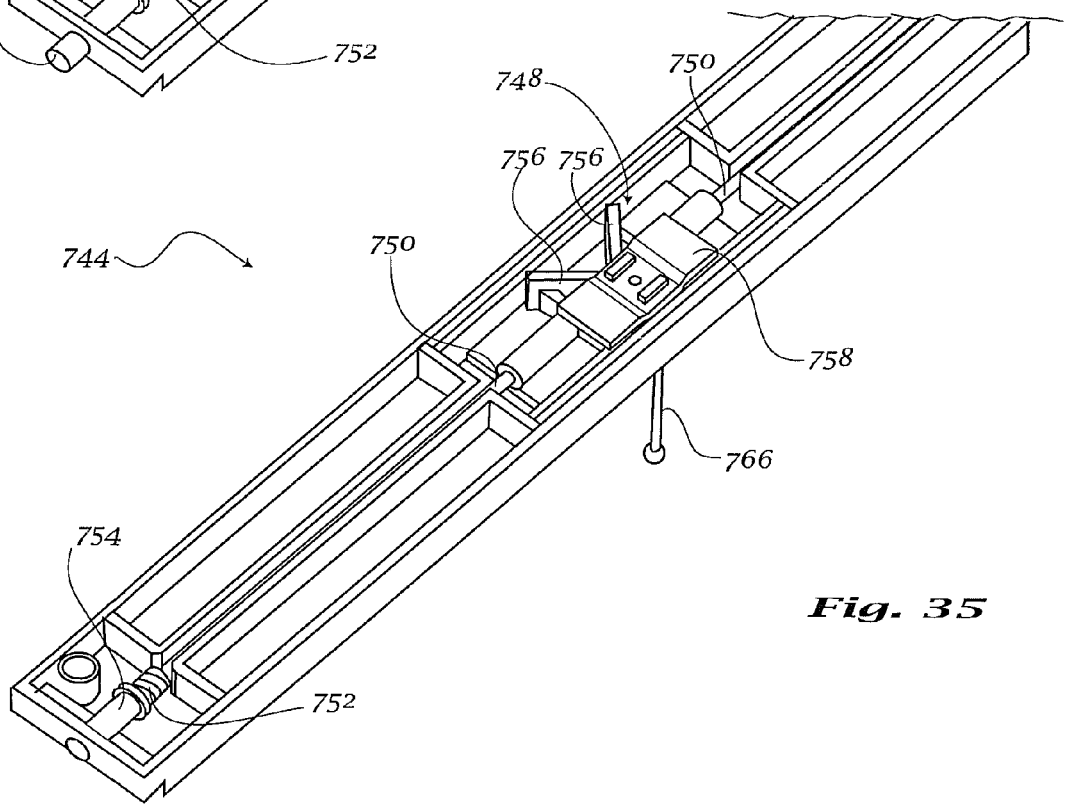
FIG. 35 is a perspective bottom view of the leading cover member shown in FIG. 30 that includes a locking assembly.
Figure 36:
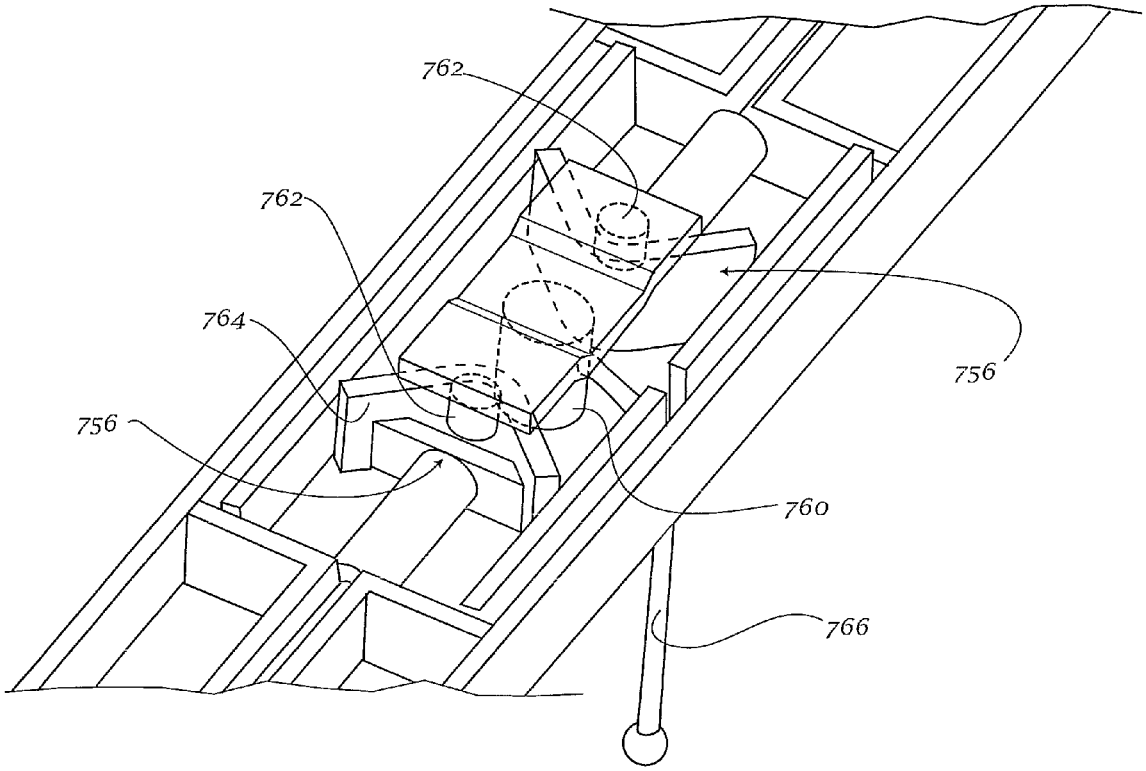
FIG. 36 is an enlarged perspective bottom view of the locking assembly shone in FIG. 34.

In one embodiment, retractable cover 734 may include a leading cover member 744 that has a cover handle 746 coupled thereto. FIGS. 30-33 show various views of leading cover member 744. Cover handle 746 enables a user to grab cover handle 746, and more specifically retractable cover 734, such that the user may open or close retractable cover 734. In one embodiment, leading cover member 744 may include a locking mechanism 748 that facilitates locking retractable cover 734 in a substantially closed position, as shown in FIGS. 34-36. Locking mechanism 748 may include a pair of locking rods 750 that may be slidably coupled within leading cover member 744. Each locking rod 750 may be coupled to a biasing member 752 that facilitates extending locking rod 750 away from a center area of leading cover member 744 such that a locking pin portion 754 of each locking rod 750 extends substantially away from leading cover member 744. In one embodiment, biasing member 752 may be a spring.

In one embodiment, top portion 704 may include a plurality of notches 755 defined therein. A first pair of notches 755 may be positioned substantially near a front end of top portion 704, and a second pair of notches 755 may be positioned substantially near a rear end of top portion 704. Notches 755 may be sized and positioned to receive locking pin portion 754 of locking rods 750 to facilitate locking retractable cover 734 in either a substantially closed position or a substantially open position. During operation, a user may pull handle 746, and more specifically retractable cover 734 from the substantially open position to the substantially closed position. Once leading cover member 744 is substantially near the front end, locking pin portions 754 may engage notches 755 to facilitate locking retractable cover 734 in a substantially locked and closed position. Moreover, the user may push handle 746 to facilitate disengaging locking pin portions 754 from notches 755 to facilitate unlocking retractable cover 734 from the locked and closed position to enable the user to open retractable cover 734. The user may then push retractable cover 734 towards the rear end of top portion 704 until locking pin portions 754 engage the second pair of notches 755, which facilitates locking retractable cover 734 in a substantially open position.

Locking mechanism 748 may include a pair of anchor members 756 that are slidably coupled to leading cover member 744. In the exemplary embodiment, anchor members 756 may be substantially triangular shaped. Alternatively, anchor members 756 may have any shape that enables locking mechanism to function as described herein. Moreover, in one embodiment, each locking rod 750 may have one end that is coupled to anchor member 756 of locking mechanism 748. Anchor members 756 may be slidably coupled to a locking rod coupler 758, wherein locking rod coupler 758 may be slidably coupled within leading cover member 744.

In one embodiment, coupler 758 may include a center spacer 760 and a pair of projections 762, wherein projections 762 may extend away from coupler 758 and extend at least partially within anchor members 756, as best shown in FIG. 36. In one embodiment, center spacer 760 may extend away from coupler 758 and may be positioned substantially between anchor members 756. Moreover, projections 762 may be slidably coupled within anchor members 756, and more specifically to an inner wall 764 of each anchor member 756 to facilitate retracting locking rods 750, as described in more detail below. Coupler 758 may also include a safety string 766 coupled to center spacer 760, to facilitate unlocking leading cover member 744 from the locked position. In the event a child is trapped within internal cavity 711 and retractable cover 734 is closed to the locked position, the child may pull the safety string 766 to unlock retractable cover 734 from top portion 704. Specifically, pulling safety string 766 facilitates moving coupler 758 from a central position towards one side of leading cover member 744. As a result, center spacer 760 also moves towards one side of leading cover member 744 such that center spacer 760 is no longer positioned substantially between anchor members 756. Moreover, projections 762 may slide along inner wall 764 of each anchor member 756, such that projections force anchor members 756, and more specifically locking rods 750 inwards towards the center of leading cover member 744. As a result, locking pin portion 754 of locking rods 750 are substantially retracted into leading cover member 744, which enables leading cover member 744 to be unlocked from top portion 704. As such, the child may slide retractable cover 734 open and exit trash container 700.

The foregoing description and accompanying figures illustrate the principles, preferred embodiments and modes of operation of the invention. However, the invention should not be construed as being limited to the particular embodiments discussed above. Additional variations of the embodiments discussed above will be appreciated by those skilled in the art.

Therefore, the above-described embodiments should be regarded as illustrative rather than restrictive. Accordingly, it should be appreciated that variations to those embodiments can be made by those skilled in the art without departing from the scope of the invention as defined by the following claims.

What is claimed is:

1. A retractable cover comprising:

a leading cover member; and a plurality of following cover members, a first of said plurality of following cover members hingedly coupled to said leading cover member and each of the other of said plurality of cover members hingedly coupled to one adjacent following cover member; and a locking mechanism coupled to said leading cover member, said locking mechanism further comprising:

at least one locking rod slidably coupled to said leading cover member;

at least one anchor member coupled to said at least one locking rod, said at least one anchor member slidably coupled to said leading cover member; and a coupler coupled to said leading cover member, wherein said coupler comprises:

a cylindrical center spacer extending substantially away from said coupler, said center spacer positioned substantially adjacent said at least one anchor member;

at least one cylindrical projection extending substantially away from said coupler, said at least one projection slidably coupled to said at least one anchor member; and a string coupled to said center spacer.

2. A container system comprising:

a bin portion comprising a bottom portion and a plurality of sidewalls extending away from said bottom portion such that an internal cavity is defined within said bin portion;

a top portion comprising a horizontal portion coupled to a vertical portion, said top portion removably coupled to said bin portion such that at least a portion of said vertical portion is coupled within said bin portion; and a retractable cover slidably coupled to said top portion, said retractable cover comprising a plurality of cover members, wherein said retractable cover further comprises:

a leading cover member that comprises:

a handle coupled to said leading cover member; and a locking mechanism coupled within said leading cover member;

wherein said sidewalls of said bin portion are substantially tapered such that a top end of said bin portion is substantially larger than a bottom end of said bin portion.

3. The container system of claim 2 further comprising a plurality of legs extending substantially away from said bottom portion.

4. The container system of claim 2 further comprising a plurality of transport wheels coupled to said bottom portion.

5. The container system of claim 2 wherein said vertical portion is positioned at a substantially right angle with respect to said horizontal portion.

6. The container system of claim 2 further comprising a tracking wheel coupled to a side wall of said top portion and positioned substantially within said top portion.

7. The container system of claim 6 wherein said tracking wheel comprises a plurality of grooves defined in an outer circumference of said tracking wheel.

8. The container system of claim 2 wherein said locking mechanism comprises:

at least one locking rod slidably coupled to said leading cover member;

at least one anchor member coupled to said at least one locking rod, said at least one anchor member slidably coupled to said leading cover member; and a coupler coupled to said leading cover member, wherein said coupler has a cylindrical center spacer extending substantially away from said coupler, said center spacer positioned substantially adjacent said at least one anchor member.

9. The container system of claim 8 further comprising a biasing member coupled to said at least one locking rod and said leading cover member.

10. The container system of claim 9 further comprising a string coupled to said locking mechanism.

11. The container system of claim 2 further comprising at least one notch defined within said top portion and positioned substantially adjacent said retractable cover member.

12. The container system of claim 2 further comprising a plurality of drainage holes defined in said vertical portion of said top portion.

13. The container system of claim 2 further comprising a guard member coupled to said top portion and extending substantially away therefrom, said guard member positioned adjacent said retractable cover member such that said guard member is slidably coupled to an outer surface of said retractable cover member.

* * * * *